United States Patent [19]

Masuda et al.

[11] Patent Number: 4,826,578

[45] Date of Patent: May 2, 1989

[54] METHOD OF PRODUCING HEAT-TRANSFER MATERIAL

[75] Inventors: Yasuo Masuda, Urawa; Tsutomu Takahashi, Ohmiya; Yoshio Takizawa, Hasuda; Naokazu Yoshiki, Kitamoto, all of Japan

[73] Assignee: Mitsubishi Kinzoku Kabushiki Kaisha, Tokyo, Japan

[21] Appl. No.: 221,999

[22] Filed: Jul. 20, 1988

Related U.S. Application Data

[62] Division of Ser. No. 928,876, Nov. 7, 1986, abandoned.

[30] Foreign Application Priority Data

| | | | |
|---|---|---|---|
| Nov. 11, 1985 | [JP] | Japan | 60-252357 |
| Nov. 11, 1985 | [JP] | Japan | 60-252358 |
| Nov. 12, 1985 | [JP] | Japan | 60-253184 |
| Feb. 22, 1986 | [JP] | Japan | 61-37736 |
| Sep. 19, 1986 | [JP] | Japan | 61-221064 |
| Sep. 19, 1986 | [JP] | Japan | 61-221065 |

[51] Int. Cl.[4] ..... C25D 5/34; C25D 7/04

[52] U.S. Cl. ..... 204/26; 204/14.1; 204/25; 204/38.1; 204/52.1

[58] Field of Search ..... 428/687, 613; 165/133; 204/38.1, 14.1, 24, 25, 26, 52.1

[56] References Cited

U.S. PATENT DOCUMENTS

| | | | |
|---|---|---|---|
| 1,807,875 | 6/1931 | Robinson | 204/38.1 |
| 2,217,334 | 10/1940 | Diggory et al. | 204/38.1 |
| 2,846,759 | 9/1958 | Foley | 29/191.2 |
| 3,293,109 | 12/1966 | Luce et al. | 204/38.1 |
| 3,857,681 | 12/1974 | Yates et al. | 204/52.1 |
| 3,884,772 | 5/1975 | Shiga | 204/16 |
| 3,925,168 | 12/1975 | Costas | 204/14.1 |
| 4,019,969 | 4/1977 | Goleblowski et al. | 204/38.1 |
| 4,186,063 | 1/1980 | Albertson | 165/133 |
| 4,199,414 | 4/1980 | Shum | 204/25 |
| 4,216,819 | 8/1980 | Notaro | 165/133 |
| 4,258,783 | 3/1981 | Albertson | 165/133 |
| 4,311,733 | 1/1982 | Inoue | 165/133 |

FOREIGN PATENT DOCUMENTS

| | | | |
|---|---|---|---|
| 2510580 | 9/1975 | Fed. Rep. of Germany | 204/25 |
| 14259 | 2/1977 | Japan | 165/133 |
| 259 | 1/1979 | Japan | 165/133 |
| 26996 | 2/1983 | Japan | 165/133 |
| 1375160 | 11/1974 | United Kingdom | 165/133 |

OTHER PUBLICATIONS

Chemical Abstracts, vol. 99, 1987, p. 440, Abstract No. 50578C, "Electroplating Printed Circuit Boards".

Metal Finishing Abstracts, vol. 22, No. 2, Mar./Apr. 1980, p. 101, letter D, "Reflective Silver Coated Strip".

*Primary Examiner*—John J. Zimmerman

*Attorney, Agent, or Firm*—Scully, Scott, Murphy & Presser

[57] ABSTRACT

A heat-transfer material includes a tubular body made of a metal. The body includes on an inner surface thereof a porous electroplated layer having re-entrant cavities. A heat transfer material is produced by: preparing a body of a metal serving as a cathode and forming a hydrophobic film on a surface of the body; subsequently keeping the surface of the body and an anode in contact with a plating aqueous solution; and subsequently applying a direct electrical potential between the anode and the cathode to cause plating current to flow through the plating solution to lay deposits of plating metal on the surface of the body and laying a number of particulate bubbles on the hydrophobic film on the surface of the body so that the bubbles are enveloped by the metal deposits to form on the surface of the body a porous plated layer having re-entrant cavities.

13 Claims, 10 Drawing Sheets

METHOD OF PRODUCING HEAT-TRANSFER MATERIAL

This is a divisional of copending application Ser. No. 928,876, filed on Nov. 7, 1986 now abandoned.

BACKGROUND OF THE INVENTION

1. Field of the Invention

The present invention relates to a heat-transfer material utilized for example as a condenser tube or an evaporator tube of a heat exchanger for use in an air conditioner, or as a heat pipe, and to a method of producing the same.

2. Related Art

Several effective ways to increase the efficiency of heat-transfer in a heat-transfer tube are generally known: (1) increasing the heat-transfer area; (2) causing a turbulent flow; (3) causing capillarity; and (4) causing nucleate boiling. As a heat-transfer tube of which efficiency of heat-transfer is improved by the above-mentioned ways (1) and (2), a copper tube having spiral grooves formed in an inner periphery thereof is conventionally employed. However, when rolling the spiral grooves in the inner periphery of the tube by a rolling apparatus, the number and helix angles of the grooves are restricted due to the restrictions on the techniques of rolling operation and of making the rolling tools. As a result, the efficiency of heat-transfer for the grooved tube can be increased to a level of only 1.2 to 1.5 times that of a tube with no grooves, thereby being not sufficient. In addition, a great force is required to roll the grooves in the manufacture of the grooved tube since great friction is exerted between the rolling tool and the inner surface of the tube. Accordingly, a large rolling apparatus is required, and besides the service life of the tool is short, thereby increasing the manufacturing cost.

Further, as a heat-transfer material improved by the above-mentioned way (4), which way is considered to be most effective, a material of a metal having a porous metal layer formed on a surface thereof by a sintering method or a brazing method is known. However, although the porous layer can be easily formed by means of sintering or brazing for a plate-like heat-transfer material, it has been difficult to form such a porous layer on the inner surface of a tubular member such as a heat-transfer copper tube by the method. Furthermore, electroplating can be employed to form the porous layer on a surface of a metal after the step of effecting pattern masking on the metal surface by screen process printing. The method, however, can not be employed to form the porous layer on the inner periphery of the tube either, and besides requires complicated steps such as printing, thereby increasing the manufacturing cost substantially.

SUMMARY OF THE INVENTION

It is therefore an object of the present invention to provide a heat-transfer material comprising a tubular body having on an inner surface thereof a porous layer which causes nucleate boiling, so that the material has an excellent efficiency of heat-transfer. Another object of the present invention is to provide a method of producing a heat-transfer material, by which method the material including the porous layer having excellent heat-transfer characteristics can be easily produced at a substantially reduced manufacturing cost.

According to the first aspect of the present invention, there is provided a heat-transfer material comprising a tubular body made of metal, the body including on an inner surface thereof a porous electroplated layer having re-entrant cavities.

According to another aspect of the present invention, there is provided a method of producing a heat-transfer material comprising the steps of preparing a body made of metal serving as a cathode and forming a hydrophobic film on a surface of the body, subsequently keeping the surface of the body and an anode in contact with a plating aqueous solution, and subsequently applying a direct electrical potential between the anode and the cathode to cause a plating current to flow through the plating solution to lay deposits of plating metal on the surface of the body and laying a number of particulate bubbles on the hydrophobic film on the surface of the body, so that the bubbles are enveloped by the metal deposits to form on the surface of the body a porous plated layer having re-entrant cavities.

DESCRIPTION OF PREFERRED EMBODIMENTS OF THE INVENTION

Figure 1:
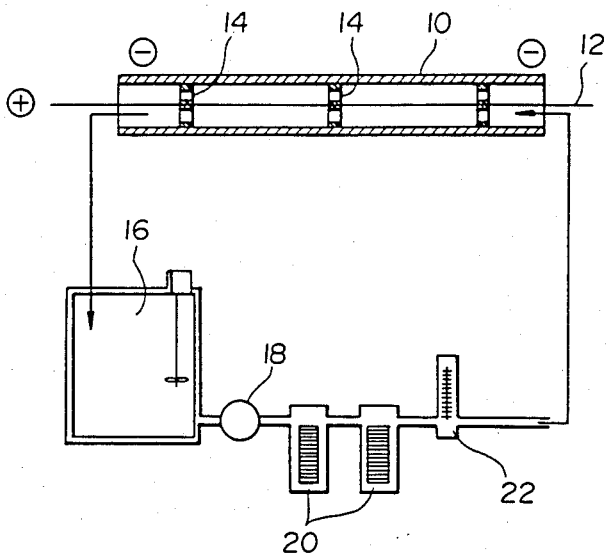
FIG. 1 is a schematic view showing an apparatus for practicing a method in accordance with the present invention.

In accordance with one embodiment of the method of the present invention, a tubular body of such metal as copper, aluminum, and stainless steel is first prepared. A hydrophobic thin film then is formed on the inner surface of the body. There are several techniques which may be practiced to form the hydrophobic film. For example, a solution which contains hydrophobic substances such as grease, oil and paint dispersed or dissolved in a solvent is prepared, and the inner surface of the body is coated with the solution by a brush or a spray. The surface of the body may be immersed in the solution, and then removed from the solution to evaporate the solvent to leave the thin film of the hydrophobic substances. While the optimum thickness of the thin film to form will vary depending upon the kinds of the hydrophobic substances, the thickness should be in the range of 0.1 to 5 μm. If the thickness thereof is below 0.1 μm, the porosity of a porous layer, which will be hereinafter described, is unduly decreased. On the other hand, if the thickness is above 5 μm, the electric insulation resistance of the film is increased, so that it becomes difficult to obtain a deposit layer evenly and uniformly plated on the surface of the body. In addition, if the tubular body is made by rolling a blank tube into a smaller diameter with lubricating oil being applied to inner and outer surfaces thereof, the lubricating oil deposited on the inner surface of the blank tube serves as the above-mentioned hydrophobic film.

As a next step the inner surface of the body, which serves as a cathode, is electroplated with a suitable plating solution for a prescribed period of time. In commencing the plating operation, a wire serving as an insoluble anode is disposed in the tubular body so as to extend generally coaxially with the body. A plurality of spacers made of an insulating material may be disposed on the wire in longitudinally spaced relation so as to keep the space from the wire to the inner surface of the body to prevent short circuit from occurring. The plating solution is caused to flow through the tubular body, and a direct electrical potential then is applied between the anode and the cathode to cause a plating current to flow through the plating solution until a plated layer is formed on the inner surface of the body. Since the wire is insoluble to the plating solution, oxygen gas is evolved in the form of a large number of particulate bubbles in the vicinity of the anode during the electroplating. The bubbles move with the flow of the plating solution, and some reach the inner surface of the body. Inasmuch as the wettability of the surface of the body for the plating solution is lowered due to the hydrophobic film thereon, the bubbles which reach the surface of the body adhere thereto. The metal deposits grow on the inner surface in such a manner as to envelop the bubbles, so that a porous metal deposit layer having re-entrant cavities of a generally cylindrical shape is formed on the inner surface of the body, each of the re-entrant cavities having an egress of an opening size reduced when compared to a size of an inner portion thereof.

The number and average size of the bubbles which adhere to the inner surface of the body are optimally controlled by regulating cathodic and anodic current densities and/or the velocity of the relative movement of the plating solution to the body. Specifically, in order to produce sufficient amount of the bubbles of oxygen gas to form the porous layer, the anodic current density should be at least 20 A/dm$^2$, and in order that the metal deposits can easily envelope the bubbles adhered to the surface of the body to form the re-entrant cavities, the cathodic current density should be at least 15 A/dm$^2$. As the plating current, a pulsating current such as an interrupted current, a conventional pulse current and a PR(periodic reverse) current is selectively utilized. Inasmuch as the pulsating current facilitates the carriage of metal ions to the cathode as compared with the conventional direct current, the electrodeposition rate is increased, and besides whisker-like or bushy deposits, which are often produced in the case of the conventional direct current, are prevented from being produced, thereby preventing short circuit from occurring due to the whisker-like deposits. Particularly in the PR current, since positive current, for which the body serves as the cathode, and negative current, for which the body serves as the anode, are alternatively periodically generated in such a manner that the duration of the application of the positive current is longer than that of the application of the negative current, even and uniform growth of the deposits on the inner surface of the body is achieved. Further, since the insoluble anode is used, it is necessary to add ions of depositing metal to maintain the concentration thereof to a suitable constant level.

As described above, the heat-transfer tube thus produced has on its inner surface the porous deposit layer having the re-entrant cavities. Accordingly, not only capillarity is caused but also nucleate boiling develops, so that the efficiency of heat-transfer is substantially increased. The heat-transfer tube thus obtained can be utilized as a heat pipe, in which the porous layer serves as wicks of the heat pipe. The heat-transfer tube to be employed as the heat pipe should have such a porous layer as to have a porosity by surface area ranging from 10 to 50%. More specifically, the percentage of the total opening area of the cavities to the surface area of the inner peripheral surface of the layer should be in the range of 10 to 50%. If the porosity is below 10%, the performance of the heat pipe becomes unduly low. On the other hand, if the porosity is above 50%, the performance is high but is not substantially improved for an increase of the manufacturing cost.

In the method described above, the flow rate of the plating solution should be at least 0.5 m/sec to move the bubbles to the surface of the body. However, the flow rate can be zero in such a case where the bubbles are caused to flow to a surface of a flat body only by buoyancy. In addition, if the flow rate is selected to be faster as in the ranges of 3 to 5 m/sec, the re-entrant cavities inclined at inclination angles with respect to an axis of the body are formed in the deposit layer. The heat-transfer material thus produced is superior in the heat-transfer performance to the material of which porous layer has re-entrant cavities with no inclination.

Further, in the method described above, the bubbles of oxygen gas produced by electrolysis of water are adhered to the inner surface of the tubular body, but other techniques can be practiced to lay such particulate bubbles on the surface to be plated. For example, gas such as nitrogen, argon, oxygen and carbon dioxide may be blown into the plating solution through a porous filter having minuscule openings to produce the particulate bubbles. The openings of the filter preferably range from 0.05 to 100 μm in size. If the openings of the filter are below 0.05 μm, it becomes difficult to supply a sufficient amount of the gas. On the other hand, if the openings of the filter are above 100 μm, the sizes of the bubbles become too large to be enveloped by the deposit metal. Another method for producing particulate bubbles in the plating solution is to add a gas-producing substance to the plating solution. The gas-producing substance may be any material which produces gas when subjected to electroplating or just mixed in the plating solution. Basic copper carbonate is one example of the latter, which, in case of copper plating, also materially helps to keep a constant concentration of the copper ions in the plating solution as the copper ions plate out on the cathode. Aqueous solution of hydrogen peroxide is not detrimental to the electroplating, and can be preferably utilized as the gas-producing substance.

The present invention will now be illustrated by the following examples:

EXAMPLE I

Referring to FIG. 1, a copper tube 10 having an outer diameter of 9.35 mm and a thickness of 0.35 mm was produced by reduction, and was cut into pieces so as to have a length of 1,000 mm. The inner surface of the tube 10 then was washed with trichloroethylene. Subsequently, an ethanol solution containing silicon oil in the strength of $\frac{1}{3}$ was held in the tube 10, and ethanol was evaporated to form a thin film of the silicon oil on the inner surface of the tube 10. A Ti-Pt wire 12 having a plurality of spacers 14 of resin mounted thereon in longitudinally spaced relation was inserted inside the tube 10 to extend generally coaxially with the tube 10. In stead of mounting the spacers, a force maybe exerted on the opposite ends of the wire 12 so that the wire is stretched to extend generally coaxially with the tube 10.

A copper sulfate plating solution was supplied from a reservoir 16 through a pump 18 to the copper tube 10, and circulated to the reservoir, the plating solution containing copper sulfate of 200 g/l and sulfuric acid 50 g/l. Filters 20 and a flowmeter 22 were, as shown in FIG. 1, mounted on the pipe connecting the pump 18 and the tube 10.

Figure 2:
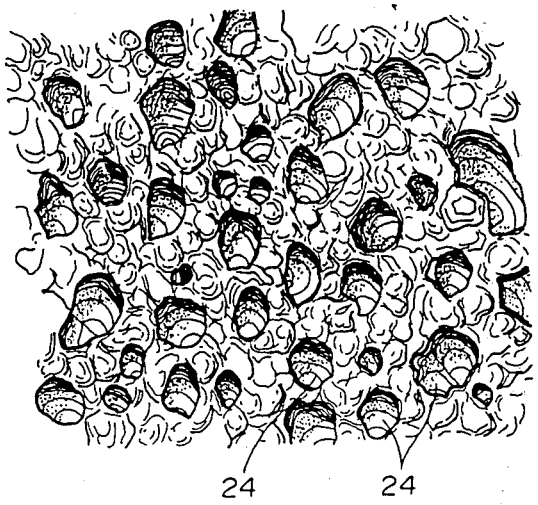
FIG. 2 is a view showing a surface of a heat-transfer material produced by the method in accordance with the present invention.
Figure 3:
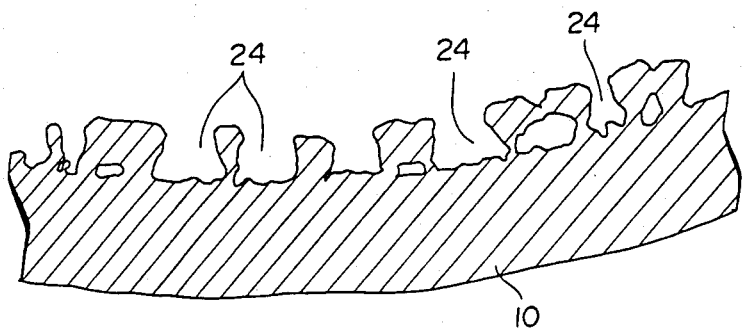
FIG. 3 is a cross-sectional view of the heat-transfer material of FIG. 2.

Electroplating then was carried out for a period of 10 minutes at a temperature of the plating solution of 30° C., a cathodic current density of 33 A/dm$^2$, an anodic current density of 80 A/dm$^2$ and a flow rate of plating solution of 2 m/sec resulting in a porous layer of deposit copper on the inner surface of the tube 10, as shown in FIGS. 2 and 3. The layer was found to be of an average thickness of 100 μm and to have re-entrant cavities 24 evenly and uniformly disposed in the inner peripheral surface and opening thereto, the average size of the re-entrant cavities 24 being 250 μm. The porosity of the porous layer by surface area was found to be 18%.

After cleaning of the inner surface of the heat-transfer tube 10 thus obtained, the tube 10 was dried and subjected to crash testing by a vise. Further, another heat-transfer tube obtained by the above-mentioned method was annealed for a period of 20 minutes at 530° C., and subjected to enlargement testing by a mandrel. In both the tests, neither peeling-off nor falling-off of the deposit metal was observed, resulting in excellent adhesion and strength of the porous layer.

Further, a heat-transfer tube was obtained in accordance with the method described above, and was subjected to testing for the heat-transfer characteristics and to comparison testing therefor with a conventional copper tube.

Figure 4:
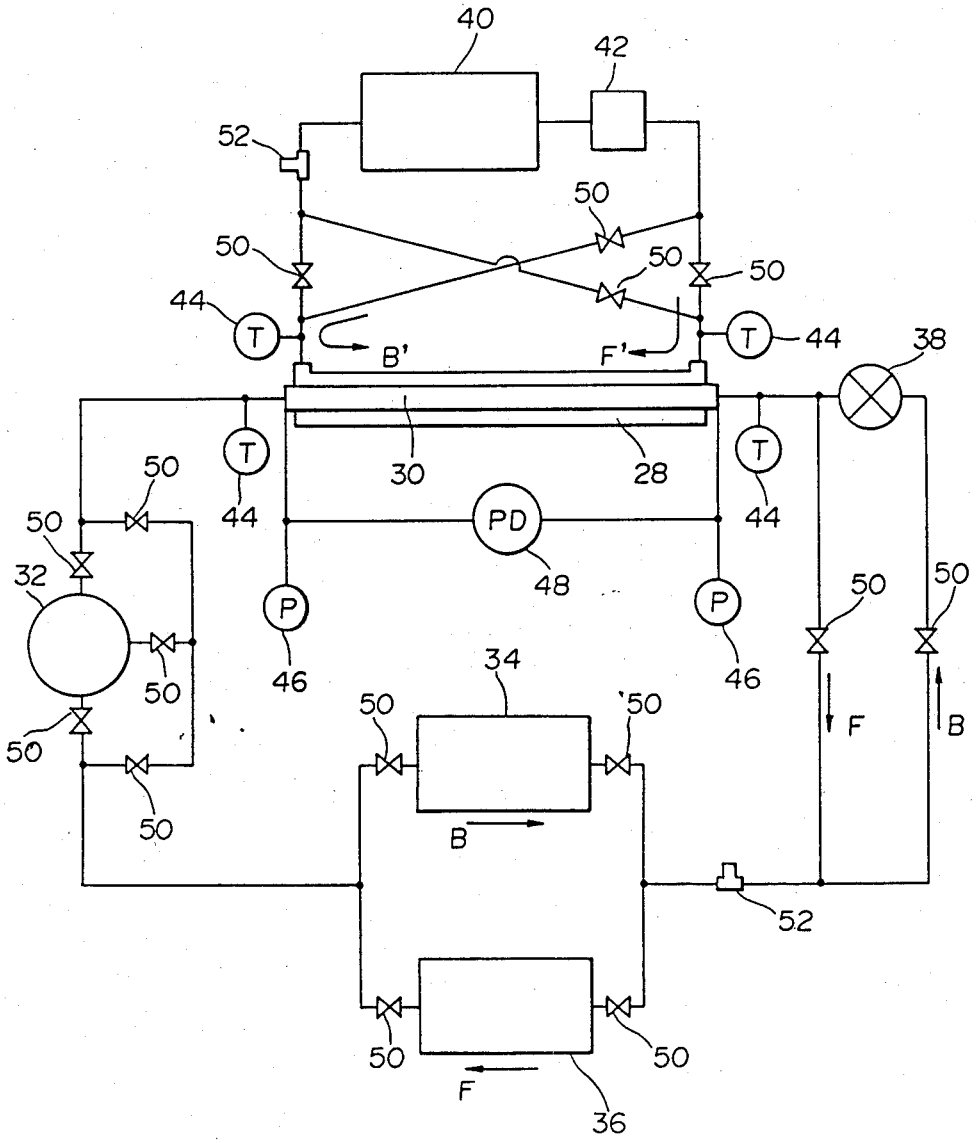
FIG. 4 is a schematic view of a device for testing the heat-transfer characteristics of a heat-transfer material.

FIG. 4 shows a testing device used for the tests. The device comprises a shell 28 in which the heat-transfer tube 30 to be tested is inserted, a compressor 32 connected to one end of the tube, a subcondenser 34 and a subevaporator 36 which are disposed in parallel to each other and connected at their one ends to the compressor, an expansion valve 38 connected at its one end to the other ends of the subcondenser and subevaporator and at its other end to the other end of the tube, a constant temperature bath 40 connected to one end of the shell and a pump 42 connected at its inlet to the bath and at its outlet to the other end of the tube. The shell and tube constitutes a double-pipe heat exchanger. The device also includes a plurality of temperature detectors 44, pressure gauges 46, a differential pressure gauge 48, valves 50 and orifice flowmeters 52.

By using the device, evaporative and condensation tests were carried out. In the evaporative test, as designated by arrows B in FIG. 4, the compressor 32 delivers the hot compressed refrigerant gas or freon gas to the subcondenser 34, where it is condensed. From the subcondenser, the liquid refrigerant flows through the expansion valve 38 to the heat-transfer tube 30 to be tested. In the tube, the liquid refrigerant is evaporated into a gas absorbing the heat from the counterflows of the warm water which passes through the shell 28. From the tube, the refrigerant gas returns to the compressor to repeat the cycle. The warm water in the constant temperature bath 40 is circulated by the pump 42 through the shell 28 in a closed circuit, as designated by arrows B'. Suppose that the temperature of the warm water decreases from $T_1$ to $T_2$ in the shell and that the refrigerant is evaporated at a temperature of $T_\theta$. Then the film coefficient of heat-transfer for the refrigerant side or boiling heat-transfer coefficient $\alpha_i$ for the heat-transfer tube is obtained by the following conventional equation.

$$\alpha_i = 1/[(1/U)-(1/\alpha_0)]$$

wherein $$U = Q/A\Delta Tm$$

$$Q = CW(T_1 - T_2)$$

$$\alpha_0 = 0.023x(\lambda/De)xRe^{0.8}xPr^{\frac{1}{3}}$$

$$De = (D_2^2 - D_1^2)/D_1$$

$$\Delta Tm = [(T_1 - T_\theta) - (T_2 - T_\theta)]/[ln(T_1 - T_\theta)/(T_2 - T_\theta)]$$

and wherein Q=heat transfer rate between the refrigerant and the warm water, C=specific heat, W=mass flow rate of warm water, $\alpha_0$=film coefficient of heat-transfer for the water side, U=overall coefficient of heat-transfer, A=surface area of heat-transfer, ΔTm=logarithmic mean temperature difference, Re=Reynolds number, Pr=Prandtle number, λ=coefficient of thermal conductivity of water, $D_1$=inner diameter of the tube and $D_2$=outer diameter of the tube.

Similarly, in the condensation test, the refrigerant and the warm water are caused to flow in the directions designated by arrows F and F', respectively, and the boiling heat-transfer coefficient for the heat-transfer tube is obtained by similar equations.

In the test, the device was automatically controlled so that the parameters, which are shown in TABLE I, were regulated to the predetermined values. The mass flow rate of the refrigerant was varied, and the boiling heat-transfer coefficient was calculated and plotted against the flow rates of the refrigerant.

TABLE 1

| | evaporation | condensation |
|---|---|---|
| mass flow rate of refrigerant (kg/hr) | 40, 60, 80 | 40, 60, 80 |
| temperature of evaporation (°C.) | 5 ± 0.5 | 5 ± 0.5 |
| superheating temperature (°C.) | 5 ± 0.5 | 5 ± 0.5 |
| temperature at the expansion valve inlet (°C.) | 35 ± 0.5 | 35 ± 0.5 |
| temperature of condensation (°C.) | 45 ± 0.5 | 45 ± 0.5 |
| subcooling temperature (°C.) | 10 ± 0.5 | 5 ± 0.5 |
| volumetric flow rate of water (1/min) | 8–10 | 8–10 |
| temperature of water (°C.) | 20–25 | 30–35 |

Figure 5:
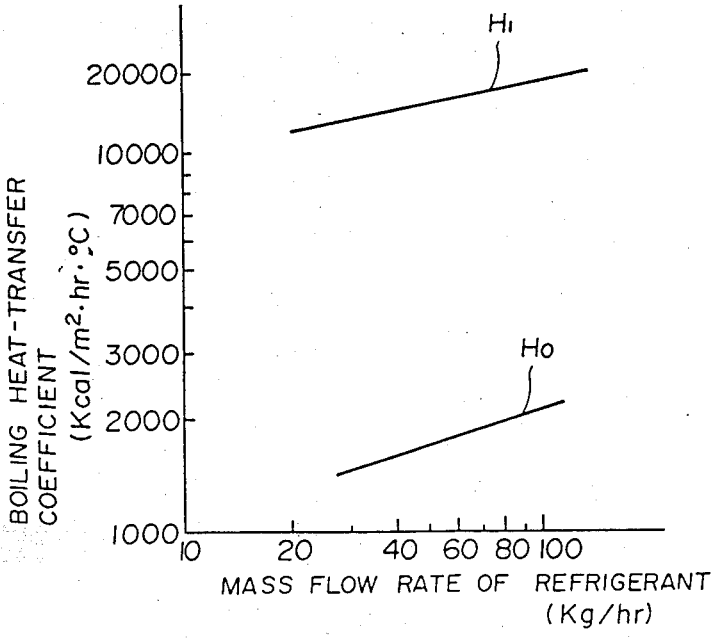
FIG. 5 is a graphical presentation showing plots of experimental results on the heat-transfer characteristics obtained by the device of FIG. 4 for the heat-transfer material of FIG. 2 and for a conventional heat-transfer material.

The results obtained are graphically depicted in FIG. 5, in which $H_1$ denotes a result for the heat-transfer tube produced according to the above-mentioned method while $H_0$ denotes a result for the conventional copper tube. It is evident from FIG. 5 that the boiling heat-transfer coefficient for the heat-transfer tube produced according to the above-mentioned method is 7 to 8 times as great as that for the conventional copper tube.

EXAMPLE II

Spiral grooves were formed by rolling in the inner peripheral surface of a copper tube having the same size as that in EXAMPLE I, and the procedure described in EXAMPLE I was repeated to form a porous layer of deposit metal having re-entrant cavities on the inner peripheral surface of the tube. The layer was formed not only on the inner peripheral surface of the tube but also on the inner surface of the grooves. The tube thus obtained was subjected to testing for the heat transfer characteristics as described in EXAMPLE I with a result that the efficiency of heat-transfer for the tube is ten times as great as that for the conventional copper tube.

EXAMPLE III

A surface of a plate having a size of 200 mm×100 mm×1 mm was coated with lubricating oil by a roll coating method to form a thin hydrophobic film on the surface. Subsequently, the surface was plated for a period of 10 minutes at a cathodic current density of 25 A/dm$^2$, an anodic current density of 25 A/dm$^2$ and a flow rate of the plating solution of 2 m/sec. The copper plate thus obtained was kept in warm water and heated from its rear side. Then, the evolution of nucleate boiling was observed.

EXAMPLE IV

Figure 6:
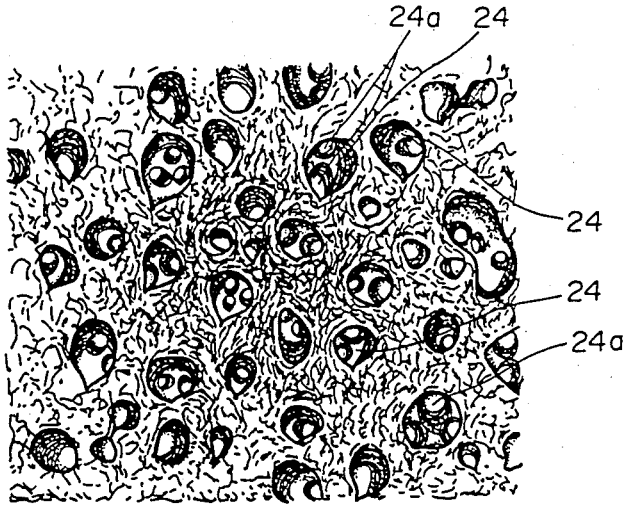
FIG. 6 is a view showing a surface of a modified heat transfer material produced by the method in accordance with the present invention.
Figure 7:
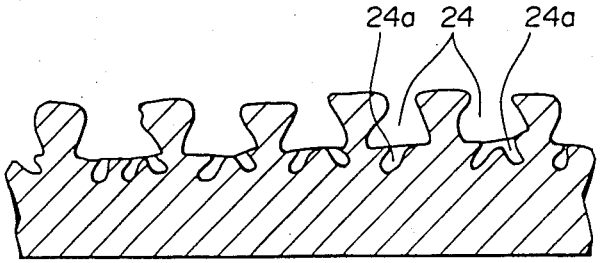
FIG. 7 is a cross-sectional view of the heat-transfer material of FIG. 6.

When the procedure described in EXAMPLE I was repeated, a porous layer having re-entrant cavities 24 each further having one or more minuscule holes 24*a* in the bottom surface thereof was unexpectedly formed on the inner surface of a copper tube, as shown in FIGS. 6 and 7. The heat-transfer tube thus obtained exhibited the coefficient of heat-transfer greater by about 20% than that the tube having no minuscule holes in the re-entrant cavities exhibited. The precise conditions under which the porous layer having minuscule holes in the re-entrant cavities was formed were not clear, but it was thought that several parameters such as the flow rate of the plating solution and the current densities were concerned.

EXAMPLE V

Figure 8:
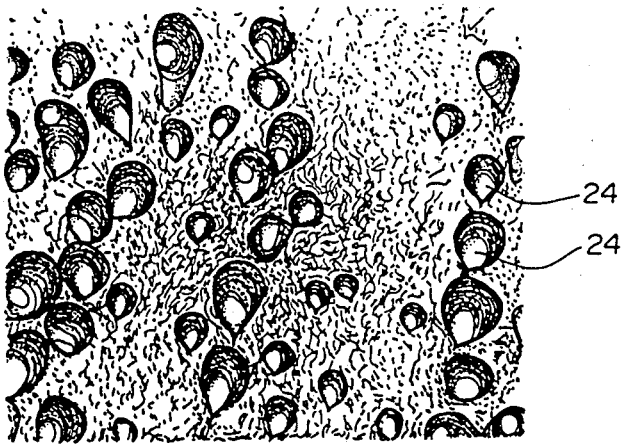
FIG. 8 is a view showing a surface of a heat-transfer material produced by a modified method in accordance with the present invention.
Figure 9:
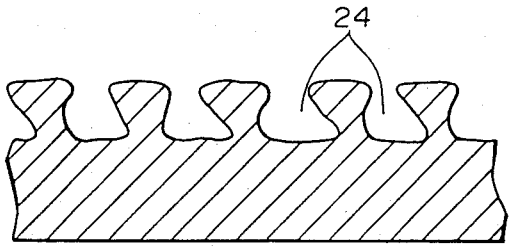
FIG. 9 is a cross-sectional view of the heat-transfer material of FIG. 8.

A copper tube having an outer diameter of 9.35 mm, a thickness of 0.35 mm and a length of 500 mm was prepared, and the procedure described in EXAMPLE I was repeated with the exception that the cathodic current density was 20 A/dm$^2$ and the flow rate of the plating solution was 4 m/sec, resulting in the layer having re-entrant cavities 24 inclined at inclination angles of about 20 degrees in the direction of the flow of the plating solution, as shown in FIGS. 8 and 9. The heat-transfer tube obtained was then subjected to testing for the heat transfer characteristics according to the method described in EXAMPLE I under the same conditions with a result that the boiling heat-transfer coefficient for the tube in accordance with this example was found to be greater by about 30% than that for the tube having re-entrant cavities with no inclination.

EXAMPLE VI

Figure 10:
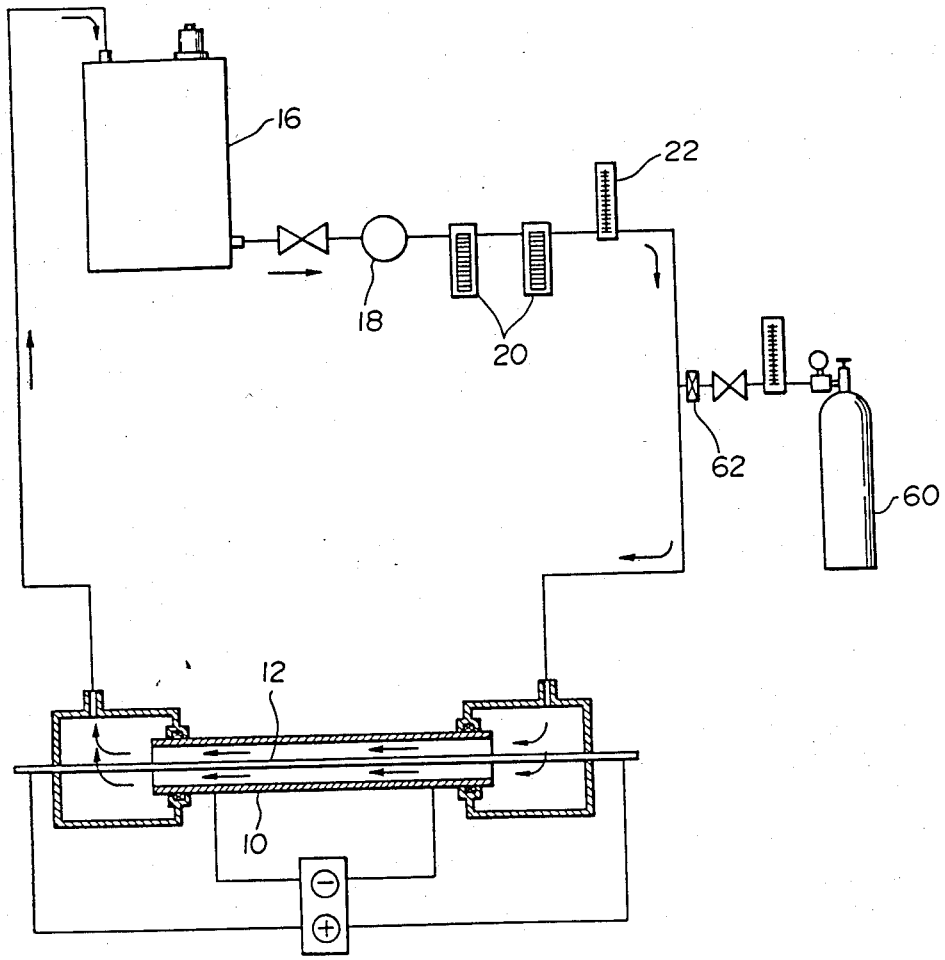
FIG. 10 is a schematic view showing an apparatus for practicing a further modified method in accordance with the present invention.
Figure 11:
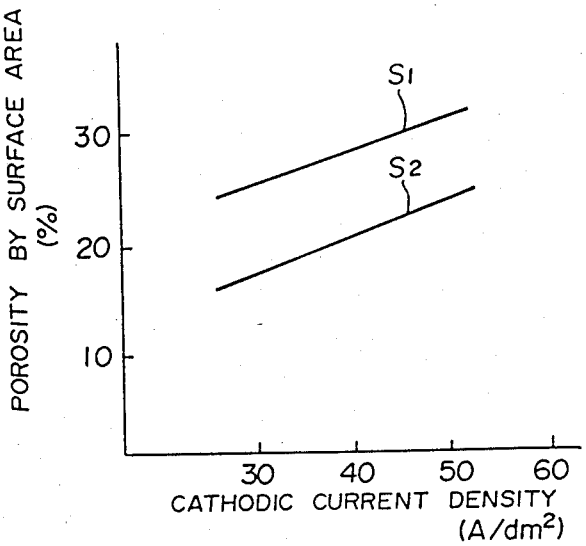
FIG. 11 is a graphical presentation showing plots of measured results on the porosity of a heat-transfer material produced by the apparatus of FIG. 10 and on the porosity of a comparative heat-transfer material.

Referring to FIG. 10, in which the same parts as or similar parts to those of the apparatus shown in FIG. 1 are designated by the same reference characters, a copper tube 10 having an outer diameter of 9.52 mm, a thickness of 0.35 mm and a length of 1,000 mm was prepared, and the procedure described in EXAMPLE I was repeated with the exception that nitrogen gas was blown from a nitrogen cylinder 60 into the plating solution through a filter 62 and that the cathodic current density was variously changed. The filter 62 had opening size of 0.2 μm, so that the gas formed a large number of particulate bubbles. The porous layer formed on the inner surface of the heat-transfer tube was found to be of a thickness of around 150 μm and to have re-entrant cavities evenly and uniformly disposed in the inner peripheral surface and opening thereto, the size of the re-entrant cavities ranging from 100 to 150 μm. The porosity of the layer by surface area was measured by an image analysis system for each of the tube, obtained in accordance with the above-mentioned method, and a comparative tube, produced without blowing the gas into the plating solution as described in EXAMPLE I. The porosities measured are plotted against the various cathodic current densities in FIG. 11, in which $S_1$ denotes the result for the heat-transfer tube obtained in accordance with the above-mentioned method while $S_2$ denotes the compartive heat-transfer tube obtained according to the method described in EXAMPLE I. From FIG. 11, it is evident that the porous layer of the tube in accordance with the above described method has a 30% greater porosity, for example at a cathodic current density of 50 A/dm$_2$, than the comparative tube.

Further, the heat-transfer tube and a conventional copper tube was subjected to testing for the heat transfer characteristics according to the method described in EXAMPLE I under the same conditions.

Figure 12:
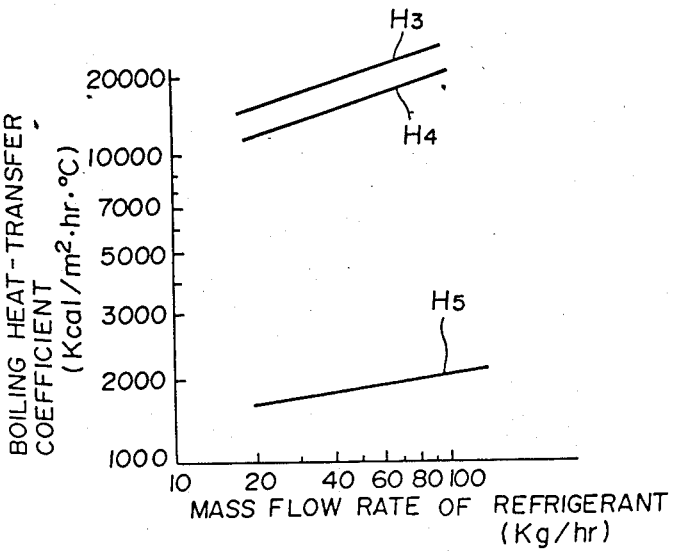
FIG. 12 is a graphical presentation showing plots of experimental results on the heat-transfer characteristics obtained by the device of FIG. 4 for heat-transfer materials produced by the apparatus of FIG. 10, and for the conventional copper tube.

The boiling heat-transfer coefficients are plotted against the cathodic current densities in FIG. 12, in which $H_3$ denotes the result for the heat-transfer tube obtained in accordance with the above-mentioned method while $H_5$ denotes the result for the conventional copper tube. From FIG. 12, it is evident that the boiling heat-transfer coefficients for the tube in accordance with the above-mentioned method is about 10 times as large as that for the conventional copper tube.

EXAMPLE VII

A heat-transfer tube was produced according to the procedure described EXAMPLE VI with the exception that a soluble copper anode was used, and the tube thus obtained was subjected to testing for the heat-transfer characteristics using the same apparatus described in EXAMPLE VI under the same conditions.

The result obtained is graphically depicted in FIG. 12 together with the results of EXAMPLE VI, the result being designated by $H_4$. From FIG. 12, it is evident that the boiling heat-transfer coefficient for the heat-transfer tube in accordance with the present example is less than that for the tube obtained in EXAMPLE VI but is far greater than that for the conventional copper tube.

EXAMPLE VIII

Figure 13:
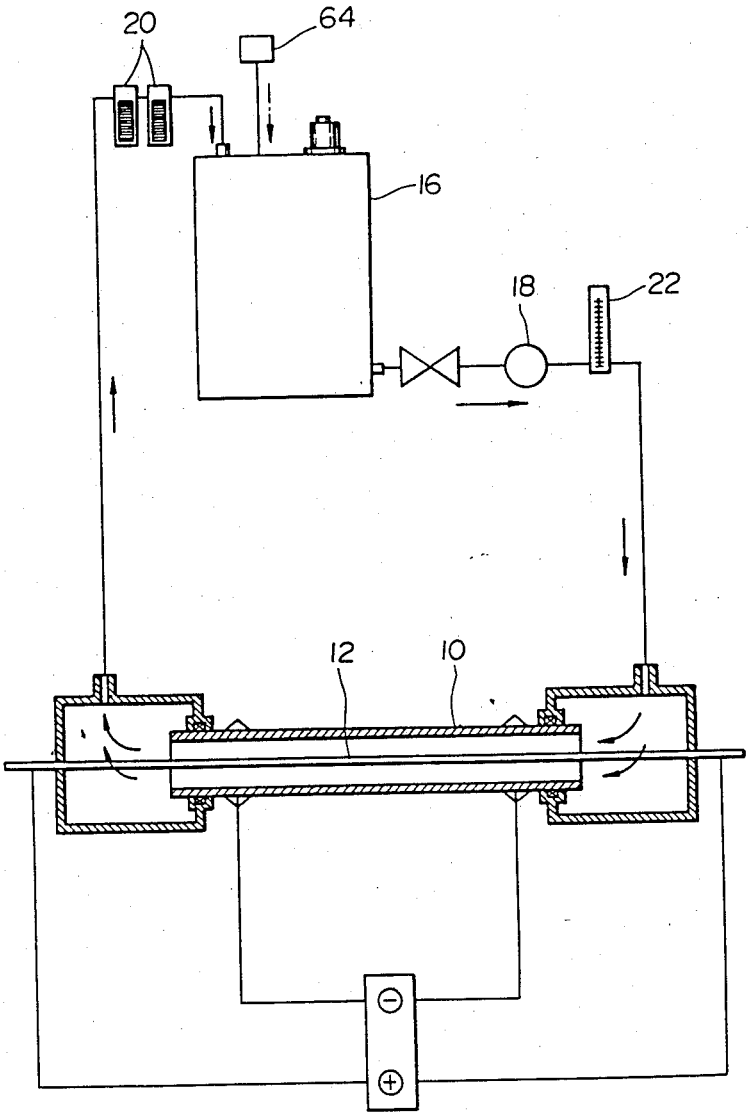
FIG. 13 is a schematic view showing an apparatus for practicing a further modified method in accordance with the present invention.
Figure 14:
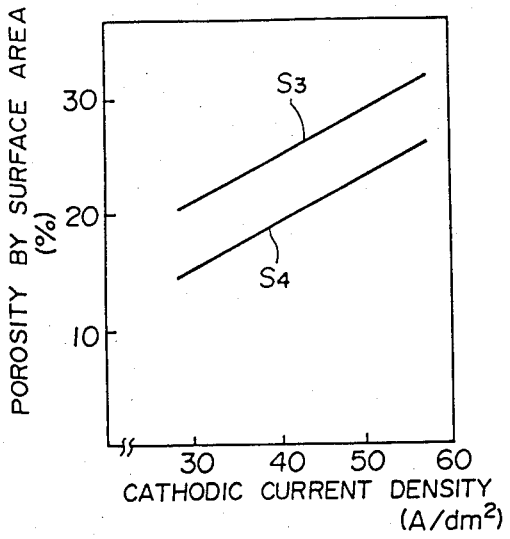
FIG. 14 is a graphical presentation showing plots of measured results on the porosity of a heat-transfer material produced by the apparatus of FIG. 13 and on the porosity of a comparative heat-transfer material.

Referring to FIG. 13, in which the same parts as or similar parts to those of the apparatus shown in FIG. 1 are designated by the same reference characters, a copper tube having an outer diameter of 9.52 mm, a thickness of 0.35 mm and a length of 1,000 mm was prepared, and a heat-transfer tube 10 was produced according to the same method as that of EXAMPLE I with the exception that basic copper carbonate was continuously added from a container 64 to the reservoir 16 at a rate of 6 g/min and that the cathodic densities were variously changed. The basic copper carbonate materially helped to keep a constant concentration of copper ions in the plating solution as copper ions plate out on the cathode, and was continuously reacted to produce carbon dioxide gas, which was caused to flow in the solution and adhere to the inner surface of the tube. The layer formed on the inner surface of the tube was found to be of an average thickness of 150 μm and to have re-entrant cavities evenly and uniformly disposed in the inner peripheral surface and opening thereto, the average size of the re-entrant cavities ranging from 100 to 150 μm. The porosity of the layer by surface area was measured by the image analysis system for each of tube obtained in accordance with the above described method and a comparative tube produced without supplying the copper carbonate into the solution, as described in EXAMPLE I. The porosities are plotted against the various cathodic current densities in FIG. 14, in which $S_3$ denotes a result for the heat-transfer tube produced according to the above-mentioned method while $S_4$ denotes a result for the comparative tube. From FIG. 14, it is evident that the layer of the tube produced in accordance with the above described method has a 30% greater porosity, for example at a cathodic current density of 50 $A/dm_2$, than the comparative tube obtained according to the method described in EXAMPLE I.

Further, the tubes were subjected to testing for the heat transfer characteristics according to the method described in EXAMPLE I under the same conditions.

Figure 15:
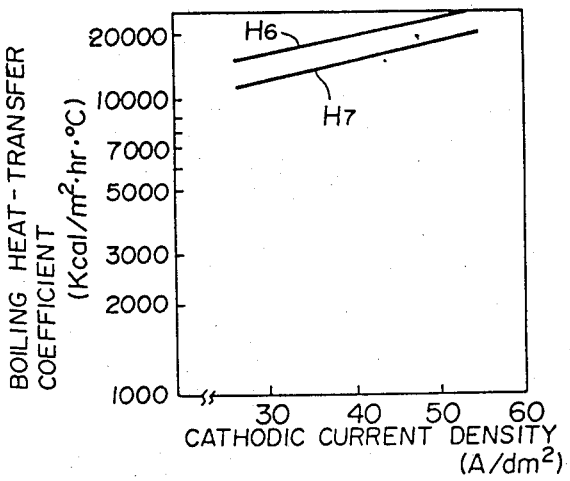
FIG. 15 is a graphical presentation showing plots of experimental results on the heat-transfer characteristics obtained by the device of FIG. 4 for the heat-transfer material produced by the apparatus of FIG. 13 and for the comparative heat-transfer material.

The boiling heat-transfer coefficients are plotted against the cathodic current densities for a flow rate of refrigerant of 60 kg/hr in FIG. 15, in which $H_6$ denotes a result for the heat-transfer tube produced according to the above-mentioned method while $H_7$ denotes a result for the comparative tube obtained according to the method described in EXAMPLE I. From FIG. 15, it is evident that the boiling heat-transfer coefficient for the tube produced in accordance with the above-mentioned method is greater for example by about 22% at a cathodic current density of 50 $A/dm_2$ than that for the comparative tube.

EXAMPLE IX

A copper tube having an outer diameter of 9.52 mm, a thickness of 0.30 mm and a length of 300 mm was prepared, and the procedure described in EXAMPLE I was repeated with the exception that the cathodic current density was 40 $A/dm^2$, resulting in the porous layer having re-entrant cavities. The porous layer was found to be of a thickness of 70 μm and to have a porosity of 20% by surface area.

Further, another copper tube having the same size as that of the above-mentioned tube was prepared, and spiral grooves were formed by rolling in the inner peripheral surface of the tube. Subsequently, the procedure described in EXAMPLE I was repeated to form a porous layer of deposit metal having re-entrant cavities on the inner peripheral surface of the tube.

Figure 16:
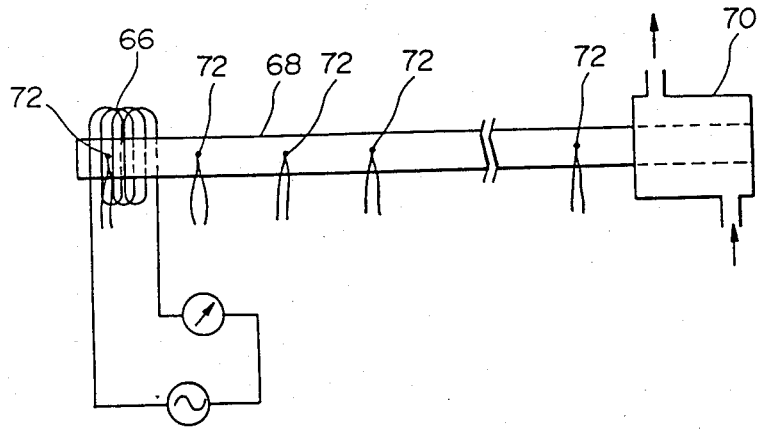
FIG. 16 is a schematic view showing a measuring equipment for the heat-transfer characteristics of heat pipes.

The heat-transfer tubes thus produced and a conventional copper tube were subjected to testing for the performance as heat pipes. Namely, each of the pipes was disposed horizontally, and water was kept in each pipe in sealing relation thereto as operating fluid, and the amount of heat transported by each heat pipe was measured by a measuring apparatus as shown in FIG. 16. The apparatus comprises an electric heater 66 attached to one end of the heat pipe 68, a water jacket 70 disposed on the other end of the pipe and a plurality of thermocouples 72 attached on the outer periphery in axially spaced relation thereto. The electrical power supplied to the heater and flow rate of water to the water jacket were so regulated that the temperature at the outer periphery of the pipe was maintained to generally 100° C., and the amount of heat transported by the heat pipe was calculated from the data on the temperature difference between the inlet and outlet of the water jacket. The results will be shown in TABLE II.

TABLE II

| test pipe | amount of heat transported |
|---|---|
| heat pipe without grooves | 60 W |
| heat pipe with grooves | 76 W |
| conventional copper tube | 25 W |

From TABLE II, it is evident that the heat pipes in accordance with the present invention were found to be superior in the amount of heat transported to the conventional heat pipe, with the amount for the first example being 2.4 times that for the conventional pipe while the amount for the second example is about 3 times. The reason was considered to be that the porous layer in each of the former examples increases the heat-transfer area, and that the re-entrant cavities facilitate the evolution of the nucleate boiling, and facilitate phase transition between liquid and gas in the side of heat transport.

As exemplified above, the method in accordance with the present invention is simple to practice and does not require any complicated or large apparatus, thereby being cost-saving as compared with the prior methods. Particularly, the method can be employed not only to form a porous heat-transfer layer on a surface of a flat body or the outer peripheral surface of a tubular body such as a copper tube but also to form such a layer in the inner peripheral surface of the tubular body, and besides it is possible to easily optimize heat-transfer characteristics of the material obtained by controlling or regulating the parameters such as the number and average size of the cavities when producing the material. In addition, the heat-transfer tube produced in accordance with the present invention has on its inner peripheral surface a porous deposit layer having re-entrant cavities. Accordingly, since not only capillarity is caused but also nucleate boiling develops with the heat-transfer material, the material has the efficiency of heat-transfer substantially increased as compared with the prior material, resulting in the use for not only excellent heat-transfer tubes for an apparatus such as a heat exchanger but a heat pipe of high performance as well.

Obviously many modifications and variations of the present invention are possible in the light of the above teachings. It is therefore to be understood that within the scope of the appended claims, the invention may be practiced otherwise than as specifically described.

What is claimed is:

1. A method of producing a heat-transfer material comprising the steps of:

(a) preparing a body made of metal serving as a cathode and forming a hydrophobic film on a surface of said body;

(b) subsequently keeping said surface of said body and an anode in contact with a plating aqueous solution; and (c) subsequently applying a direct electrical potential between said anode and said cathode to cause a plating current to flow through said plating solution to lay deposits of plating metal on said surface of said body and laying a number of particulate bubbles on said hydrophobic film on said surface of said body, so that said bubbles are enveloped by said metal deposits to form on said surface of said body a porous plated layer having re-entrant cavities.

2. A method of producing a heat-transfer material according to claim 1, in which said anode is made of substance insoluble to said plating solution on electroplating to produce oxygen gas generating in the form of said particulate bubbles in the vicinity of said anode during the electroplating, said body and said plating solution being moved relative to each other to cause said particulate bubbles to flow to said surface of said body.

3. A method of producing a heat-transfer material according to claim 1, in which a gas-producing substance is mixed in said plating solution to produce gas generating in the form of said particulate bubbles when subject to electroplating or mixed in said plating solution.

4. A method of producing a heat-transfer material according to claim 1, in which gas is blown into said plating solution to form said bubbles.

5. A method of producing a heat-transfer material according to claim 4, in which said gas is blown into said plating solution through porous filter means having openings the sizes of which range from 0.05 to 100 $\mu$m.

6. A method of producing a heat-transfer material according to claim 1, in which said body is a tube having said surface internally thereof.

7. A method of producing a heat-transfer material according to claim 1, in which said body is a tube having said surface externally thereof.

8. A method of producing a heat-transfer material according to claim 1, in which said hydrophobic film has a thickness of 0.1 to 5 $\mu$m.

9. A method of producing a heat-transfer material according to claim 1, in which said plating current is a pulsating current.

10. A method of producing a heat-transfer material according to claim 1, in which said metal body is made of copper, said plating solution being copper sulfate aqueous solution.

11. A method of producing a heat-transfer material according to claim 1, in which said body and said plating solution are moved relative to each other at a velocity of 3 to 5 m/sec to cause said re-entrant cavities to be inclined at prescribed inclination angles with respect to said surface of said body.

12. A method of producing a heat-transfer material according to claim 1, in which a cathodic current density is not less than 20 A/dm$^2$ while an anodic current density is not less than 15 A/dm$^2$.

13. A method of producing a heat-transfer material according to claim 6 or claim 7, in which said tube is made by rolling a blank tube into a smaller diameter, lubricating oil being applied to inner ahd outer surfaces of said blank tube during said rolling operation, said lubricating oil deposited on the surfaces of said tube serving as said hydrophobic film.

* * * * *